US005341772A

United States Patent [19]

Döhring et al.

[11] Patent Number: 5,341,772

[45] Date of Patent: Aug. 30, 1994

[54] INTAKE MANIFOLD FOR AN INTERNAL COMBUSTION ENGINE HAVING A CYLINDER HEAD

[75] Inventors: Klaus Döhring, Heidelberg, Fed. Rep. of Germany; Tom Boardman, Lanconia, N.H.; Chris Andrews, New London, N.H.

[73] Assignee: Firma Carl Freudenberg, Weinheim, Fed. Rep. of Germany

[21] Appl. No.: 88,287

[22] Filed: Jul. 6, 1993

[30] Foreign Application Priority Data

Jul. 3, 1992 [DE] Fed. Rep. of Germany ..... 4221913

[51] Int. Cl.[5] ..... F02M 35/10; F02M 25/06; F02F 1/42; F01M 13/00

[52] U.S. Cl. ..... 123/184.21; 123/572; 123/568; 123/339

[58] Field of Search ..... 123/52 M, 52 MB, 52 MC, 123/52 MV, 568, 572, 339

[56] References Cited

U.S. PATENT DOCUMENTS

| | | | |
|---|---|---|---|
| 3,043,286 | 7/1962 | Blomberg | 123/52 M |
| 4,068,637 | 1/1978 | Takamiya | 123/52 M |
| 4,262,639 | 4/1981 | Motosugi et al. | 123/52 M |
| 4,325,346 | 4/1982 | Yokoyama | 123/52 M |

*Primary Examiner*—Tony M. Argenbright
*Assistant Examiner*—M. Macy
*Attorney, Agent, or Firm*—Kenyon & Kenyon

[57] ABSTRACT

An intake manifold for an internal combustion engine having a cylinder head is disclosed. The intake manifold includes at least one intake pipe with an intake flange for leak-free attachment of the manifold to the cylinder head by way of a sealing element. A bypass line is provided for feeding a secondary gas into the intake opening of the internal combustion engine. The secondary gas is fed into the bypass line through a connection, preferably a hose connection. The bypass line is formed by a groove in the intake flange which is open in the direction of the cylinder head and delimited on one side by the intake flange and on the other side by a sealing element. The connection is connected to one end of the groove, and the intake opening is connected to the other end of the groove.

14 Claims, 3 Drawing Sheets

INTAKE MANIFOLD FOR AN INTERNAL COMBUSTION ENGINE HAVING A CYLINDER HEAD

BACKGROUND OF THE INVENTION

1. Field of the Invention

The present invention relates to an intake manifold for an internal combustion engine having a cylinder head. The intake manifold includes at least one intake pipe having an intake flange for leak free attachment of the intake manifold to the cylinder head by means of a sealing element. A bypass line for feeding a secondary gas into an intake opening of the internal combustion engine is provided, and the secondary gas is fed by means of a connection into the bypass line.

2. Description of the Related Art

Intake manifolds are known and generally are manufactured of a metallic material or of plastic. In this type of device, a secondary gas is often fed into the internal combustion engine through lines which are located outside the intake manifold. Because of the manner in which such intake manifolds are manufactured, the intake manifold can have undesirable accumulations of material in its interior, in particular in the transition region between intake pipe and intake flange.

SUMMARY OF THE INVENTION

It is the object of the present invention to provide an intake manifold with a bypass line for feeding a secondary gas which is integrated into the intake manifold itself. The intake manifold should also be capable of easy and economical manufacture, and undesirable accumulations of material within the intake manifold should be avoided.

In order to allow for simplified feeding of a secondary gas into the internal combustion engine, the bypass line in the present invention is formed by a groove in the intake manifold flange, which is open in the direction towards the cylinder head. The groove is connected at one end to a secondary gas connection, and at the other end to an intake opening in the intake manifold. It is advantageous if the secondary gas flows through the connection and then into the bypass line, and the bypass line is delimited on one side by the intake flange and on the other side by a sealing element. The secondary gas passes through the bypass line directly into the intake pipe and thus into the internal combustion engine. The bypass line can be manufactured very easily since the groove which acts as the bypass line is an integral component with the rest of the intake manifold. In the case of a plastic manifold, undesired accumulations of material, which are quite unsatisfactory from the standpoint of manufacture since they lead to differing shrinkage, can be avoided. This is achieved by varying the bypass groove depth to maintain constant wall thickness in the design and manufacture of the intake manifold of the invention. In the simplest case, the groove can extend directly up to the cylinder head and be sealed off thereon by a sealing element. The cross-section of the bypass line can be adapted to the corresponding circumstances of each application in an optimal manner by adjusting the routing and the depth of the groove.

The secondary gas can, for example, be vented out of the crankcase of the internal combustion engine, with the secondary gas connection being connected to a crankcase vent of the internal combustion engine.

The secondary gas hose connection of the present invention can be connected to an exhaust gas return device or an idle filling control of the internal combustion engine. The secondary gases occurring in these areas can thereby be returned to the engine and utilized for the combustion in the internal combustion engine.

When using the intake manifold of the present invention on multi-cylinder internal combustion engines, the secondary gas connection can be arranged symmetrically between the intake pipes of the intake manifold so that the bypass line consists of at least two partial sections of equal length. It is advantageous if equal quantities of the secondary gas are conducted into the intake pipes associated with the individual cylinders, so that the same mixture is available to all cylinders, thereby resulting in optimal combustion. In the case of a four-cylinder in-line engine—in an arrangement of the connection between the two central intake pipes—the partial sections of the bypass line for the two central intake pipes can be guided at least partially around said pipes while the two outer intake pipes are connected by a relatively direct path to the secondary gas connection.

In accordance with one advantageous embodiment, the secondary gas connection can be a hose connection and be made integral with the intake flange. This arrangement results in a good seal and good properties in use during a long service life.

In accordance with another advantageous embodiment, the secondary gas connection can be formed by at least one opening in the cylinder head. This embodiment is advantageous because no additional hoses are required, with the result that the installation space of the internal combustion engine may thereby be smaller and maintenance work is unnecessary for the additional hoses.

On the side of the intake manifold facing the cylinder head, the bypass line can be delimited by a seal which is made of an elastomeric material. Depending on the circumstances of the particular application, the elastomeric material can surround a seal support which is constructed of a rigid material, in which case the connection can be made integral with the seal support. The seal can be positioned in the groove by a holding device integrally formed thereon, thereby facilitating assembly of the intake manifold and maintain position throughout its life.

The holding device described above can, for example, be formed by a molded section of the seal support which protrudes in the direction of the groove so that the holding section is brought into engagement with the groove. Uniform wall thicknesses of the intake manifold and of the cross-section of the bypass line can be precisely maintained by using the seal since the seal can close by means of sealing beads adjacent to the holding device a part of the groove which is open in the direction towards the cylinder head.

In one advantageous embodiment, the intake manifold is manufactured of a polymeric material. As a result, the intake manifold can be easily manufactured and has reduced weight as compared with a metallic intake manifold.

For attachment of the intake manifold to the cylinder head, the intake flange, which can be made of plastic, may have openings into which bushings of a non-creeping material—for instance a sintered metal—can be inserted by force-locking and/or form-locking. This arrangement is advantageous because the intake manifold is permanently attached to the cylinder head and relaxation phenomena of the plastic used do not lead to impairment of operation of the intake manifold. The bushings are supported at one end directly on the cylinder head and at the other end by an attachment element, for example a screw. The bushings can have toothing, for example, in the area of their surface which engages the plastic of the intake manifold. This arrangement ensures the transmission of force between the bushing and the flange.

BRIEF DESCRIPTION OF THE DRAWINGS

One embodiment of the intake manifold of the present invention is shown with reference to the attached drawings. The drawings show the individual components in a diagrammatic representation.

DESCRIPTION OF THE PREFERRED EMBODIMENTS

Figure 1:
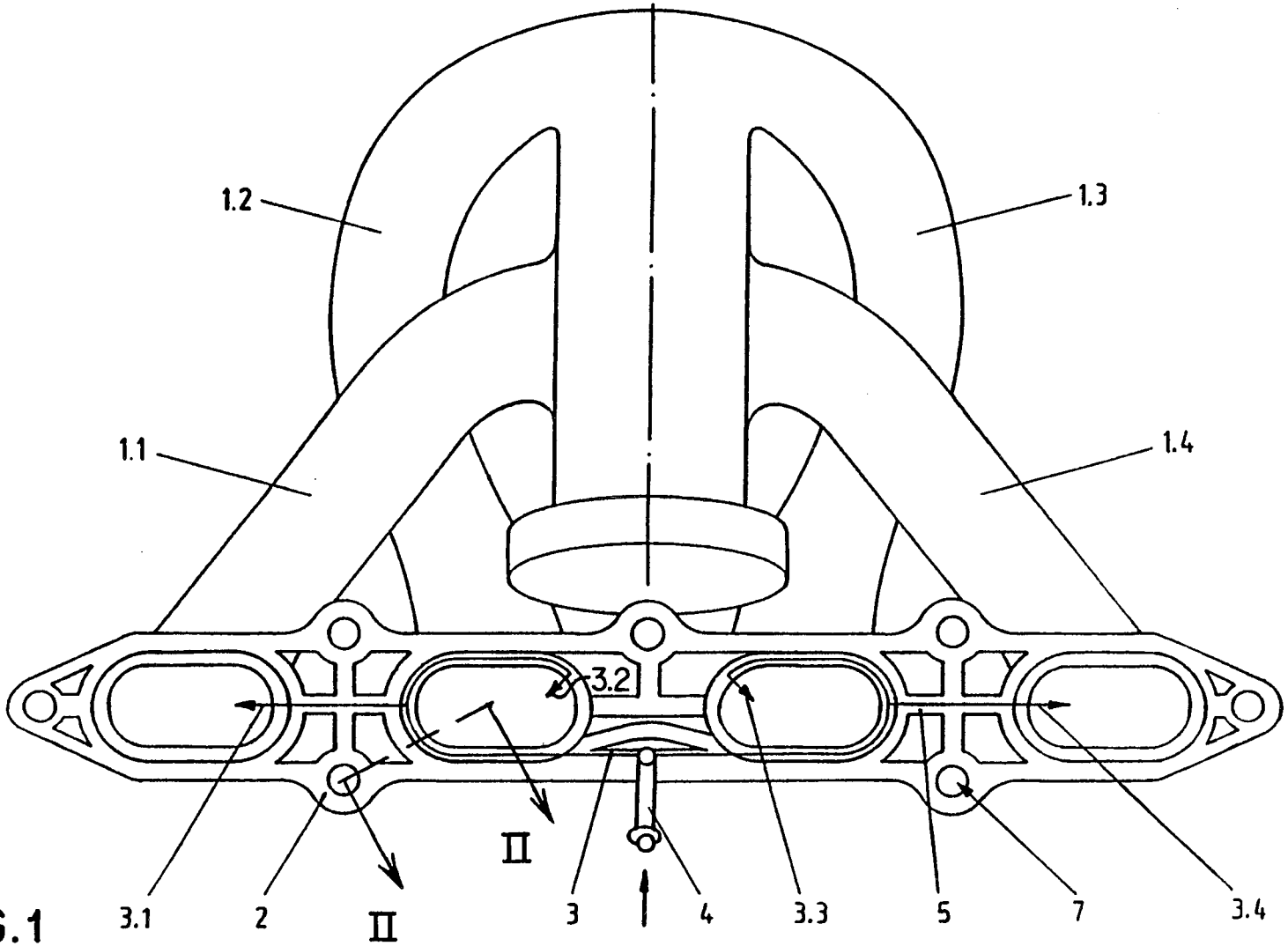
FIG. 1 is a front view of the intake manifold.
Figure 3:
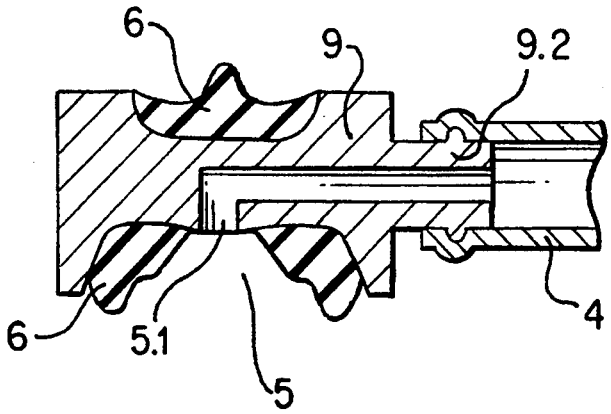
FIG. 3 is a detail cross-sectional view of the hose connection as it connects to the seal support of the present invention.

FIG. 1 shows a front view of an intake manifold for an internal combustion engine having four cylinders. The intake manifold contains intake pipes 1 for each cylinder (designated in FIG. 1 as 1.1, 1.2, 1.3, 1.4) and an intake manifold flange 2. Flange 2 is used to connect the intake manifold to the cylinder head. A bypass line 3 is provided with a hose connection 4 which together serve to feed a secondary gas into the internal combustion engine. In the embodiment of FIG. 1, the hose connection 4 may be connected to a vent from the crankcase of the internal combustion engine. As shown in FIG. 3, the hose connection 4 is connected to a seal support connection 9.2, which includes a channel 5.1 for directing secondary gases into the intake manifold. The bypass line 3 is formed by a groove 5 in the intake manifold flange 2. The groove is open in the direction facing the cylinder head, making the bypass line easy to manufacture. In the FIG. 1 embodiment, the hose connection is made integral with the intake flange 2 and is connected to one end of the groove 5. The groove 5 extends from the hose connection 4 to the intake pipe 1 of the intake manifold. The hose connection 4 is arranged symmetrically between the intake pipes 1.1–1.4 and the bypass line 3 is divided into four partial sections 3.1–3.4, each section being of equal length. The two intake pipes 1.2, 1.3 closest to the connection 4 are connected to the crank case vent via the partial sections 3.2, 3.3 which extend at least partially along the circumference of the intake pipes 1.2, 1.3. The partial sections 3.1, 3.4 of the bypass line 3 which lead from the connection 4 into the outer intake pipes 1.1, 1.4, have the same length as the adjacent partial sections 3.2, 3.3.

Figure 2:
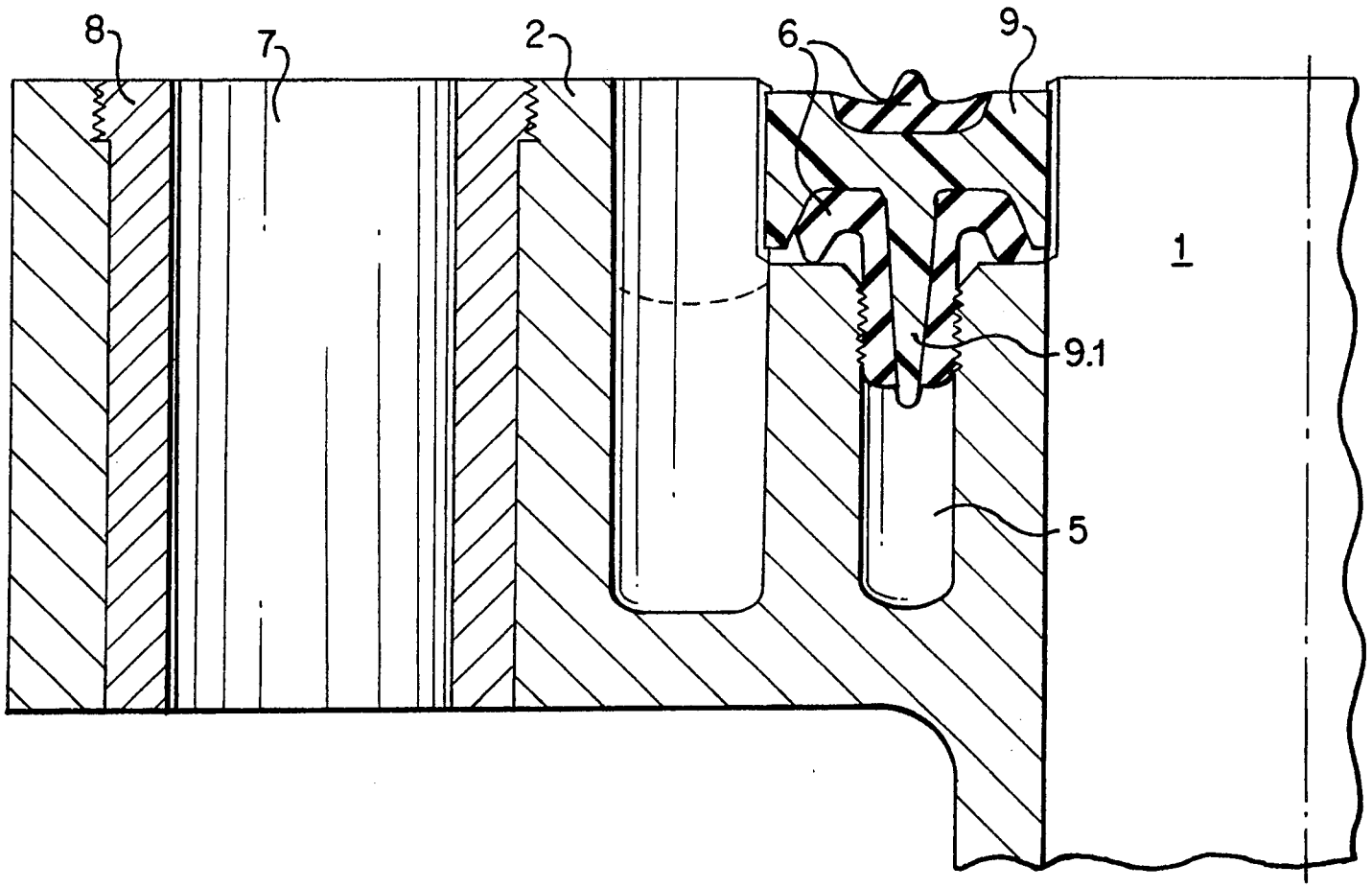
FIG. 2 is a detail of the intake manifold according to FIG. 1, shown in section.

To seal the intake flange 2 off from the cylinder head, a seal 6 of an elastomeric material is provided. As shown in FIG. 2, the seal 6 comprises a seal support 9 of a rigid plastic which is partially surrounded by an elastomeric material. The seal support 9 is positioned in the groove 5 by a projection 9.1. In accordance with an embodiment differing from that shown in FIG. 1, the hose connection can be made integral with the seal support 9. Different embodiments of the seal 6—for example without seal support 9 when used with a connection 4 which is formed by an opening in the cylinder head—are also possible. The groove 5 is arranged between intake pipe 1 and opening 7. The wall thicknesses of the intake manifold are essentially identical so that undesired accumulations of material are avoided. The bushings 8, which are force-locked and/or form locked in the opening 7, can be made, for example, of brass. The bushings 8 can have over a partial region of their axial extent a surface structure intended for reliable fixing in position within the opening 7, such as the threading shown in FIG. 2. The use of bushings 8 of a different, non-creeping material, such as sintered metal, is also possible.

Figure 4:
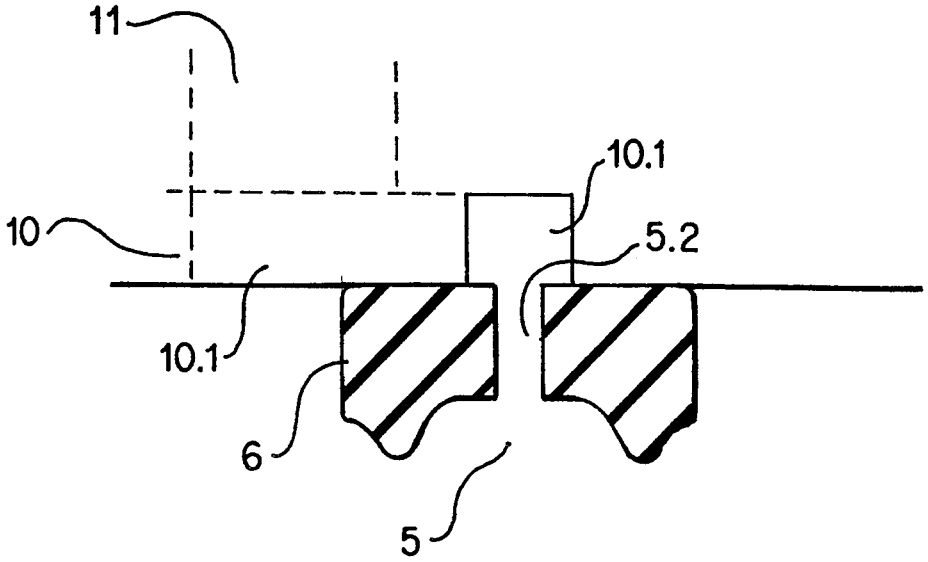
FIG. 4 is a detail cross-sectional view of the connection used when the secondary gases are fed from the cylinder head.

FIG. 4 shows a second embodiment in which the secondary gases are fed from the cylinder head 11. Seal 6 includes a channel hole 5.2 which connects the groove 5 with a transfer groove 10.1 in the cylinder block 10. The transfer groove 10.1 passes through the cylinder block 10 to the cylinder head 11, allowing secondary gases to pass from the cylinder head to the channel hole 5.2, and thus into the groove 5. In all other aspects, the embodiment of FIG. 4 operates in the same manner as the embodiment shown in FIGS. 1—3.

We claim:

1. An intake manifold for an internal combustion engine having a cylinder head comprising:

at least one intake pipe;

an intake manifold flange for leak free attachment of the intake manifold to the cylinder head;

a bypass line for feeding a secondary gas into an intake opening of the internal combustion engine; and a secondary gas connection for providing said secondary gas into said bypass line, wherein the bypass line is formed by a groove in the intake flange open in the direction of the portion of the flange which is attached to the cylinder head, and wherein the secondary gas connection is connected to one end of the groove and the intake pipe is connected to the other end of the groove.

2. An intake manifold according to claim 1, wherein: the secondary gas connection is connected to a crankcase vent of the internal combustion engine.

3. An intake manifold according to claim 1, wherein: the secondary gas connection is connected to an exhaust gas return device.

4. An intake manifold according to claim 1, wherein: the secondary gas connection is connected to an idle filling control device.

5. An intake manifold according to claim 1, further comprising:

at least two of said intake pipes, and wherein said secondary gas connection is located symmetrically between said intake pipes and said bypass line comprises at least two partial sections of approximately equal length.

6. An intake manifold according to claim 1, wherein: said secondary gas connection is a hose connection, and wherein the hose connection is integral with the intake manifold flange.

7. An intake manifold according to claim 1, wherein: the bypass line is limited on the side facing the cylinder head by a seal formed at least partially of an elastomeric material.

8. An intake manifold according to claim 7, wherein: the seal is formed by an elastomeric material surrounding a seal support.

9. An intake manifold according to claim 8, wherein:

the secondary gas connection is integral with the seal support.

10. An intake manifold according to claim 9, wherein:

the seal support has at least one holding device in the region of the bypass line.

11. An intake manifold according to claim 1, wherein:

said intake manifold is constructed of a polymeric material.

12. An intake manifold according to claim 11, wherein:

the intake manifold flange has openings for attachment of the intake manifold to the cylinder head via fasteners through said openings, and wherein bushings made of a non-creeping material are fixedly inserted in the openings.

13. An intake manifold according to claim 12, wherein:

the bushings are made of a sintered metal.

14. An intake manifold/cylinder head combination, comprising:

an intake manifold; and a cylinder head, said intake manifold comprising:

at least one intake pipe;

an intake manifold flange for leak free attachment of the intake manifold to the cylinder head;

said cylinder head comprising:

a bypass line for feeding a secondary gas into an intake opening of the internal combustion engine; and a secondary gas connection for providing said secondary gas into said bypass line, wherein the bypass line is formed by a groove in the cylinder head open in the direction of the portion of the cylinder head which is attached to the intake flange, and wherein the secondary gas connection is connected to one end of the groove and the other end of the groove is open in an area adjacent said intake pipe.

* * * * *